US005318310A

United States Patent [19]

Laberge

[11] Patent Number: 5,318,310

[45] Date of Patent: Jun. 7, 1994

[54] RUNNER SUPPORT FOR A SKATE

[75] Inventor: Raymond Laberge, St-Luc, Canada

[73] Assignee: Sport Maska Inc., Quebec, Canada

[21] Appl. No.: 935,711

[22] Filed: Aug. 27, 1992

[51] Int. Cl.[5] ..... A63C 1/00

[52] U.S. Cl. ..... 280/11.17; 280/11.12

[58] Field of Search ..... 280/11.12, 11.17, 11.18, 280/11.27, 11.3

[56] References Cited

U.S. PATENT DOCUMENTS

| | | | |
|---|---|---|---|
| 1,094,434 | 4/1914 | Golden | 280/11.3 |
| 1,098,199 | 5/1914 | Wharrad | 280/11.12 |
| 1,405,981 | 2/1922 | Drevitson . | |
| 2,179,852 | 11/1939 | Hirschman | 29/148 |
| 2,242,870 | 5/1941 | Prosey | 280/11.18 |
| 3,212,786 | 10/1965 | Florjancic et al. | 280/11.12 |
| 3,558,149 | 1/1971 | Weidenbacker | 280/11.12 |
| 3,954,278 | 5/1976 | McLeod | 280/11.12 |
| 3,967,832 | 7/1976 | Chambers | 280/11.12 |
| 4,074,909 | 2/1978 | Baikie | 280/11.12 |
| 4,093,249 | 6/1978 | Chambers | 280/11.12 |
| 4,131,288 | 12/1978 | Wilson | 280/11.17 |
| 4,336,948 | 6/1982 | Couture | 280/11.12 |
| 4,773,658 | 9/1988 | Bourque et al. | 280/11.12 |

FOREIGN PATENT DOCUMENTS

| | | | |
|---|---|---|---|
| 0585720 | 10/1959 | Canada . | |
| 0984422 | 2/1976 | Canada . | |
| 0985322 | 3/1976 | Canada . | |
| 1026781 | 2/1978 | Canada . | |
| 2820681 | 11/1978 | Fed. Rep. of Germany | 280/11.12 |
| 9000425 | 1/1990 | PCT Int'l Appl. | 280/11.3 |
| 0021779 | 12/1905 | Sweden | 280/11.3 |

*Primary Examiner*—Margaret A. Focarino
*Assistant Examiner*—Peter English
*Attorney, Agent, or Firm*—Keck, Mahin & Cate

[57] ABSTRACT

A blade support made of molded plastics including an elongated V-shaped beam with a hollow pedestal extending upwardly from the rear of the beam to meet the sole in the heel area of the skate boot. A second pedestal extends from the inner wing of the beam to be joined to the sole at the ball of the foot. A third pedestal extends from the outer wing of the beam to be joined to the sole of the boot coincident with the joint formed by the metatarsus and phalange of the fifth digit of the foot, and a fourth pedestal extends from the front end of the beam to be joined to the front end of the sole. A U-shaped sole plate joins the second, third, and fourth pedestals and provides a mounting flange for mounting the support to the boot.

8 Claims, 3 Drawing Sheets

RUNNER SUPPORT FOR A SKATE

BACKGROUND OF THE INVENTION

1. Field of the Invention

The present invention relates to a runner support for a skate, and more particularly, to a molded support for an ice skate blade.

2. Description of the Prior Art

Almost all ice hockey skates used today include a molded plastics blade support. Previously, ice skate blade supports were made of sheet metal and included a longitudinally extending tube to which the blade was fixed and two or more pedestals extending upwardly from the tube to be fastened to the sole of a skate boot. The sheet metal support was replaced by the molded plastics skate support because of the lower cost, and the market perception that the molded support is more acceptable to contemporary taste. Examples of such molded supports are illustrated in Canadian Patent 585,720, issued Oct. 27, 1959 to John E. Kirkpatrick et. al., and Canadian Patent 984,422, issued Feb. 24, 1976 to Hugh E. Baikie.

However, the known molded plastics support is inferior to the sheet metal version in several respects. For instance, in order to maintain the support light, unobtrusive, and streamlined, the longitudinal tube was essentially eliminated.

The support should lend lateral rigidity to the blade in order to minimize the absorption of energy during pronation and supination of the foot. The blade and the support are fixed relative to the sole of the skate boot; thus, the maximum reaction force should be transmitted to the body to propel the body forward. This is especially true in ice hockey where it is desirable to accomplish rapid acceleration and changes of direction.

Thus, in order to improve the molded support, it is important to design a support which approaches the rigidity of a sheet metal tube support while not increasing the weight of the molded support relative to the sheet metal blade.

Many molded plastics supports utilize more material than is required. The now well-known "Tuuk" blade, described in Canadian Patent 984,422 and U.S. Pat. No. 4,074,909, issued Feb. 21, 1978, to Hugh E. Baikie, comprises a shell defining two pedestals with the front pedestal covering most of the toe and forward metatarsal area of the sole while the rear pedestal covers all of the heel. A flange is required surrounding each pedestal to accommodate rivets in order to attach the blade support to the sole. Furthermore, a large "bridge" member extends longitudinally between the pedestals to substitute for the tube of a sheet metal support. Arches or cavities are provided to reduce the weight of this "bridge".

Other patents, such as U.S. Pat. No. 3,967,832, issued Jul. 6, 1976 to Alan F. Chambers, describe a molded plastics support which initiates the configuration of a sheet metal support. However, the molded plastics material does not have the strength characteristics of a sheet metal support in such a configuration. Furthermore, the pedestals of the skate described in Chambers are in-line and narrow, leaving a rather wide planar flange on either side of the pedestals. Such planar flanges, when made out of plastics, do not exhibit sufficient structural strength, especially in pronation-supination.

SUMMARY OF THE INVENTION

It is an aim of the present invention to provide a runner support configuration which is suitable to be manufactured as a molded plastics structure, yet maintains suitable strength to support the runner against lateral forces and to maintain rigidity during supination-pronation.

A further aim of the present invention is to maintain the mass of the skate support equal to or less than the mass of a typical sheet metal runner support, while exhibiting comparable strength characteristics.

In a construction according to the present invention, a skate is provided which would include a skate boot having a sole, a skate runner and a runner support for fixing and retaining the runner relative to the sole. The invention is embodied in the support which includes an elongated beam member extending the length of the runner and means attaching the runner to the elongated beam member. A first pedestal extends upwardly from the rear portion of the elongated member to be joined to the heel portion of the sole, and at least a second and third pedestal extend upwardly from the forward part of the elongated beam member to be joined to the forward part of the sole. The second pedestal extends from the elongated beam member to the sole in the area of the ball of the foot which is generally at the joint of the metatarsus and phalange of the first digit. The third pedestal extends from the the elongated beam to the sole of the boot in the area of the joint of the metatarsus and phalange of the fifth digit.

In a more specific embodiment of the present invention, the support consists of an elongated longitudinal beam member, a first tubular pedestal extending from the rear of the elongated beam member to the heel area of the sole, a second tubular pedestal extending from the elongated beam member to the area of the sole coincident with the joint of the metatarsus and the phalange of the first digit, a third tubular pedestal extending from the elongated beam member and the joint of the metatarsus and the phalange of the fifth digit, and a fourth pedestal extending from the front end of the elongated beam member to the front end of the sole.

In a still further, more specific embodiment, a sole plate is integral with the second, third and fourth pedestals and has a margin which is near the edge of the sole in the forward area, and the second and third pedestals extend close to the margin of the sole plate.

During maximum skating speeds, such as in the game of ice hockey, forward propulsion is achieved by a gliding technique. The push-off to accelerate the body forward is applied laterally to the direction of glide of the skate. The principal loading areas of the foot include the calcaneus (heel region) and the heads of the metatarsals. In fact, a triangle can be drawn between the joint of the metatarsus and phalange of the first digit, the joint of the metatarsus and phalange of the fifth digit, and the heel of the foot. This represents the main contact points of the foot within the skate boot during a skating motion. In order to best accelerate the body during the skating stroke, the forces must be transmitted to the blade with a minimum loss of energy. This transmission of the forces requires that the blade support and sole of the boot be relatively rigid; otherwise, the energy or the force which is being transmitted is partially absorbed in the flexing of the structure such as the support.

By providing the pedestals at the contact points of the foot on the sole in the triangle described above, and by locating the second and third pedestals as close as possible to the inner and outer edges of the sole of the boot, an efficient transmission of the accelerating forces is provided with the minimum of flexing of the structure while maintaining a low weight factor if the support is made of molded plastics or similar materials.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
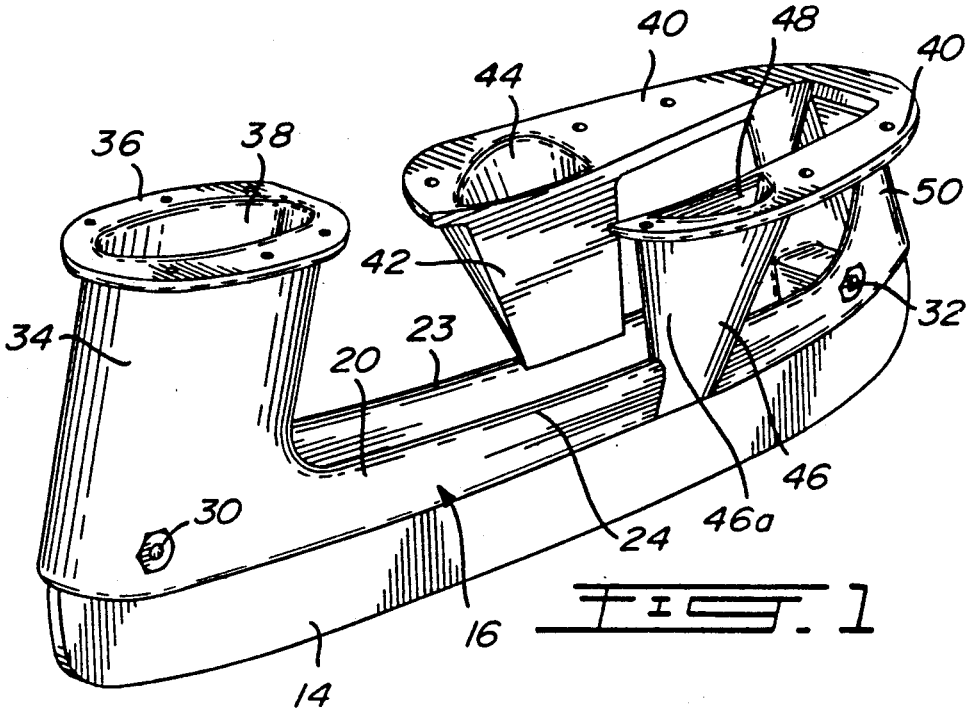
FIG. 1 is a perspective view of a hockey skate support in accordance with the present invention.
Figure 2:
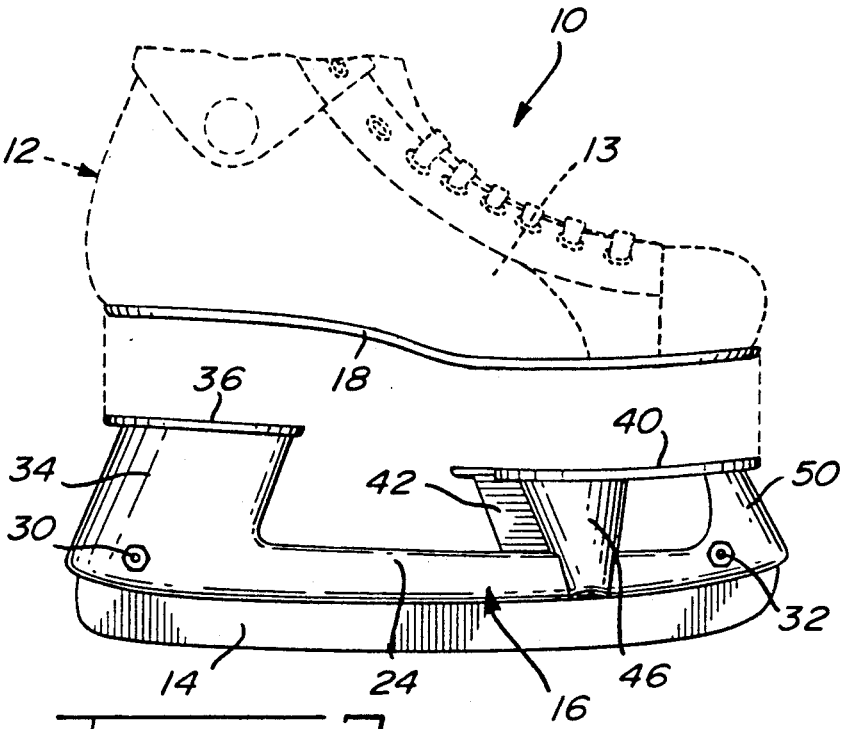
FIG. 2 is a side, exploded view of a hockey skate embodying the support of the present invention.
Figure 3:
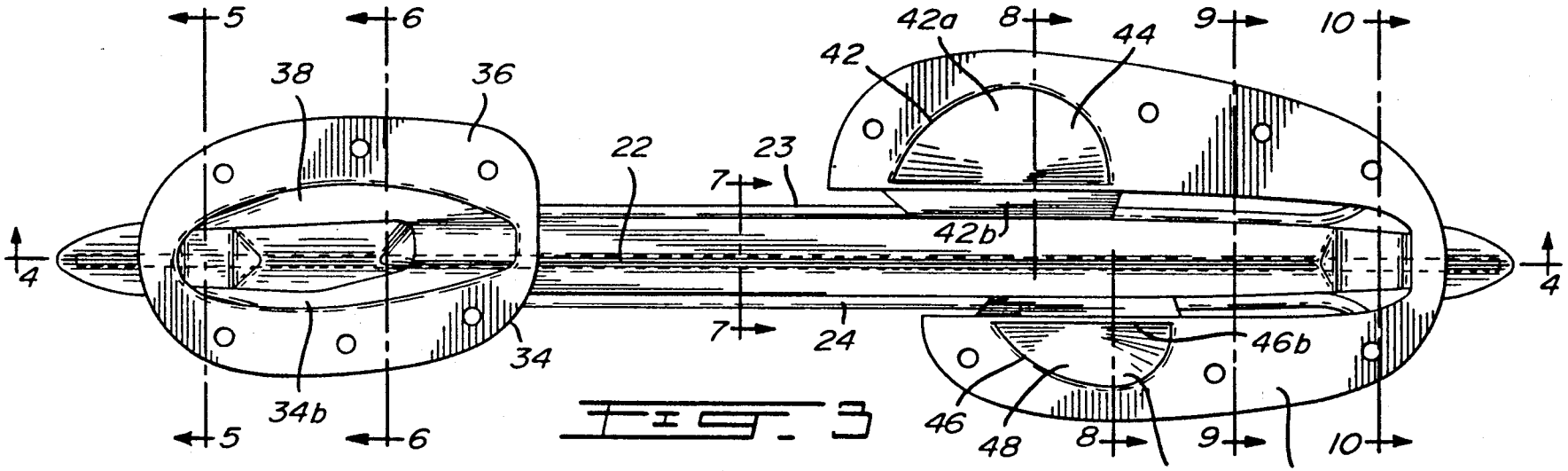
FIG. 3 is a top plan view of the hockey skate support shown in FIG. 1.
Figure 4:
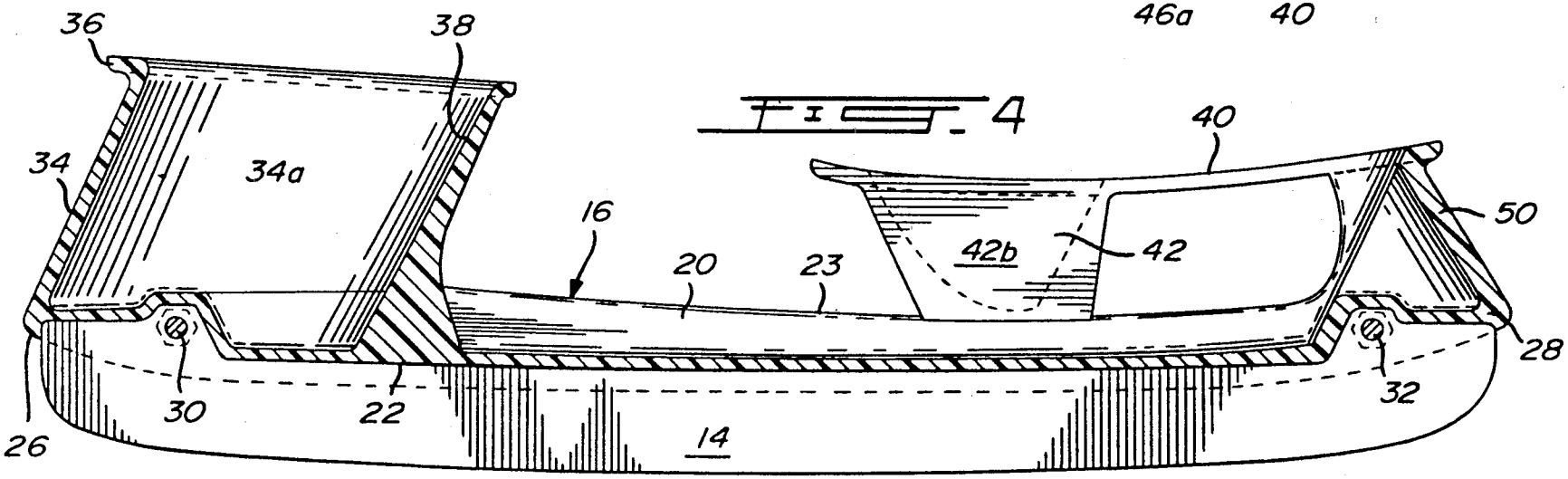
FIG. 4 is a vertical cross-section taken along line 4—4 of FIG. 3.
Figure 5:
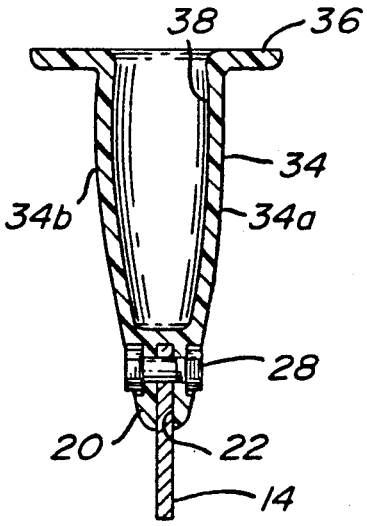
FIG. 5 is a vertical lateral cross-section taken along line 5—5 of FIG. 3.
Figure 6:
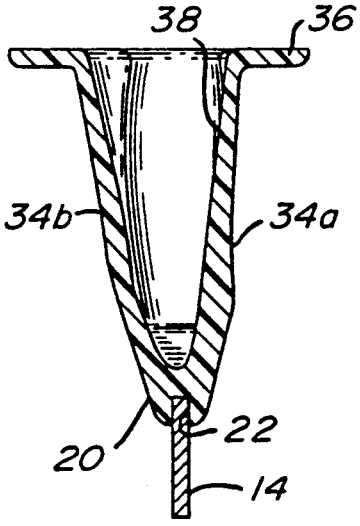
FIG. 6 is a vertical lateral cross-section taken along line 6—6 of FIG. 3.
Figure 7:
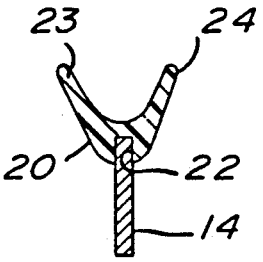
FIG. 7 is a vertical lateral cross-section taken along line 7—7 of FIG. 3.
Figure 8:
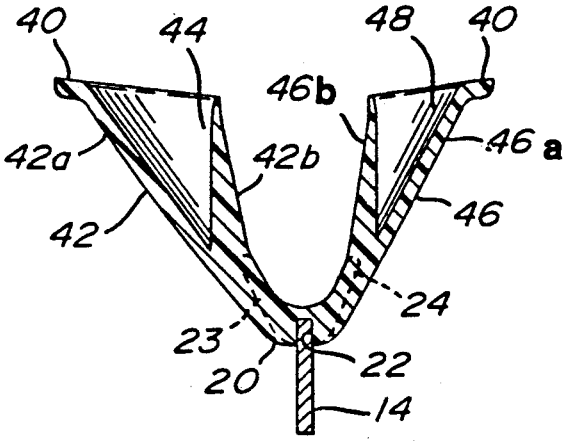
FIG. 8 is a vertical lateral cross-section taken along line 8—8 of FIG. 3.
Figure 9:
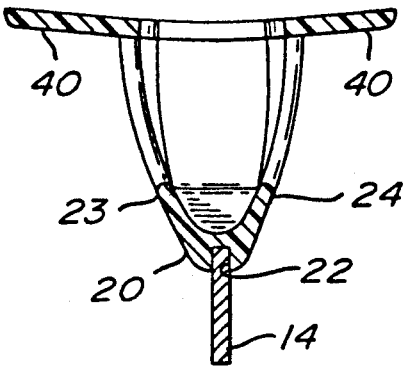
FIG. 9 is a vertical lateral cross-section taken along line 9—9 of FIG. 3.
Figure 10:
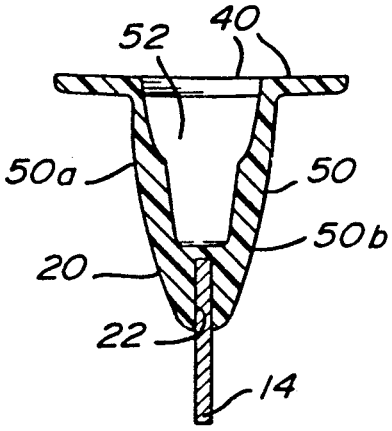
FIG. 10 is a vertical lateral cross-section taken along line 10—10 of FIG. 3.

Referring now to the drawings, an embodiment of the present invention is shown in which a hockey skate 10 includes a boot 12 including an upper 13 and a sole 18. A hockey skate blade 14 is partly embedded or removably inserted in a molded plastics blade support 16.

The blade support 16 includes an elongated longitudinal beam 20 having a V-shaped cross-section with wings 23 and 24 extending at an acute angle from the apex of the beam 20. An elongated longitudinal slot 22 is defined at the apex of the beam 20 to receive the blade 14. The beam 20 includes a rear end 26 and a front end 28. A nut and bolt arrangement 30 is provided near the rear end 26 of the beam 20 to anchor the blade 14 in the support 16. Likewise, a nut and bolt arrangement 32 is provided near the front end 28 of the beam 20 to anchor the other end of the blade 14 in the support 16.

The wings 23 and 24 are designed to provide lateral rigidity to the beam 20 and thus to the blade 14.

A rear hollow tubular pedestal 34 is provided near the rear end 26 of the beam 20 and extends forwardly at a slight angle and is adapted to engage the heel portion of the sole 18 on the skate boot 12. The rear pedestal 34 includes an opening 38 defining relatively thin side walls **34*a* and 34*b*. A flange 36 surrounds the upper edge of the tubular pedestal 34. Holes are provided in the flange 36 to allow the flange to be riveted to the sole 18**.

An inner hollow tubular pedestal 46 extends from the wing 24 of the beam 20 and is integral with the sole plate 40. The pedestal 46 includes a recessed opening 48 defining thin wall **46*a* having an arcuate horizontal cross-section and a planar wall 46*b*. The pedestal 46 extends from the wing 24 towards the inner side of the sole and coincides with the ball of the foot or the joint between the metatarsus and the phalange of the first digit (big toe). The wall 46*a* extends at an angle to the plane of the blade to adjacent the edge of the sole plate 40 and, in fact, the flange area between the wall 46*a* and the edge of the sole plate 40 is too narrow to accommodate any rivet. However, because of the relatively small size of the pedestal 46, rivet holes can be accommodated fore and aft of the pedestal 46 on the sole plate 40**.

On the outer side of the support, staggered slightly rearwardly of the pedestal 46 is a hollow tubular pedestal 42 which extends from the wing 23 of beam 20 and includes a planar wall **42*b* and an arcuate wall 42*a* to define a hollow tube with a recessed opening 44. The pedestal 42 is integral with the sole plate 40, and the wall 42*a* slopes outwardly of the support to adjacent the edge of the sole plate 40. As with the pedestal 46, the area between the pedestal wall 42*a* and the edge of the sole plate 40 is too narrow to accommodate rivets. However, rivet holes can be accommodated fore and aft of the pedestal 42. The pedestal 42** is meant to coincide with the joint of the metatarsus with the phalange of the fifth digit or the small toe.

As previously described, the pedestals 34, 42 and 46 are located at the contact points of the triangle defined by the heel and the forward portion of the foot to provide maximum transfer of the forces of the foot during the skating stroke.

A further pedestal 50 may be provided at the front end 28 of the beam 20 which will extend between the beam 20 and the front of the sole plate 40 to provide maximum transmission of the forces provided by the toes urging against the sole during acceleration of the body. Pedestal 50 is U shaped in cross section and includes walls **50*a* and 50*b***.

The provision of the strategically located pedestals in the triangular contact points of the foot in the skate boot allows the utilization of the minimum amount of material in order to maintain a low weight in terms of the support with improved rigidity along the lines of transmission of forces from the foot to the blade.

I claim:

1. In a skate having a skate boot and a sole, a skate runner and a runner support for fixing and retaining the runner to the sole, wherein the support includes an elongated beam member extending the length of the runner, and means are provided for attaching the runner to the beam, the elongated beam having a V cross-section throughout its length, open upwardly relative to the runner, the bean having at least a pair of flared wings, each co-extensive with the runner and defining the open V, the pair of wings including an inner wing and an outer wing relative to each foot, a first hollow tubular pedestal extending upwardly from the rear portion of the elongated beam to be joined to the heel portion of the sole and a second hollow tubular pedestal extending from the inner wing of the elongated beam to the sole in the area of the ball of the foot which is generally at the joint of the metatarsus and phalange of the first digit, and a third hollow tubular pedestal extending from the outer wing to the sole of the boot in the area of the joint of the metatarsus and phalange of the fifth digit of the foot, the second and third hollow tubular pedestals each having innermost walls extending upwardly from the inner wing and outer wing of the beam respectively and said second and third pedestals each having outwardly and upwardly diverging outermost walls diverging from the inner wing and outer wing of the beam respectively.

2. A skate as defined in claim 1, wherein the skate is a hockey skate and thesupport is a molded plastics member, wherein the first hollow pedestal includes a flange about the upper edge of the pedestal to be fastened to the sole of the boot, and the second hollow pedestal extends from the inner wing of the beam and is integral with a sole plate defining a flange about the second pedestal to be fastened to the sole of the boot, the sole plate extending about the margin of the support coincident with the forward part of the sole and is integral with the third pedestal to form a flange about the third pedestal, the second and third pedestals being staggered in the longitudinal direction and including planar walls facing each other and spaced apart.

3. A skate as defined in claim 2, wherein a longitudinal groove is provided in the beam to receive the blade, and nut and bolt arrangements are provided for fastening the blade to the support.

4. In a skate having a skate boot and a sole, a skate runner and a runner support for fixing and retaining the runner to the sole, wherein the support includes an elongated beam member extending the length of the runner, and means are provided for attaching the runner to the elongated beam member, a first pedestal extends upwardly from the rear portion of the elongated beam member to be joined to the heel portion of the sole, and at least a second and third pedestal extend upwardly from the forward part of the elongated beam member to be joined to the forward part of the sole, the second pedestal extends from the elongated beam member to the sole in the area of the ball of the foot which is generally at the joint of the metatarsus and phalange of the first digit, and the third pedestal extends form the elongated beam to the sole of the boot in the area of the joint of the metatarsus inner and outer portions of the beam respectively and said second and thirds pedestals each having outwardly and upwardly diverging outermost walls diverging from the inner and outer portions of the beam respectively.

5. In a skate as defined in claim 4, wherein the elongated beam member has a V cross-section open upwardly relative to the runner, the elongated beam member having a pair of flared wings, each coextensive with the runner and defining the open V, the pair of wings including an inner wing and an outer wing relative to each foot, and the second and third pedestals extending upwardly from the inner wing and the outer wing respectively of the elongated beam member.

6. In a skate as defined in claim 4, wherein the pedestals are in the form of hollow tubes.

7. In a skate as defined in claim 6, wherein a fourth pedestal extends from the front end of the elongated beam member to the front end of the sole of the boot, and the fourth pedestal has a U shape cross-section open towards the rear.

8. In a skate as defined in claim 4, wherein a fourth pedestal extends from the front end of the elongated beam member to the front end of the sole of the boot.

* * * * *